US007322336B2

(12) United States Patent
Paul et al.

(10) Patent No.: US 7,322,336 B2
(45) Date of Patent: Jan. 29, 2008

(54) CRANKSHAFT BEARING FOR AN INTERNAL COMBUSTION ENGINE

(75) Inventors: Michael Paul, Weissach (DE); Joachim Gruenberger, Sachsenheim (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 2 days.

(21) Appl. No.: 11/313,754

(22) Filed: Dec. 22, 2005

(65) Prior Publication Data

US 2006/0130798 A1 Jun. 22, 2006

(30) Foreign Application Priority Data

Dec. 22, 2004 (DE) ..... 10 2004 061 684

(51) Int. Cl.
*F02F 7/00* (2006.01)

(52) U.S. Cl. ..... 123/195 R; 123/198 DA

(58) Field of Classification Search ..... 123/195 R, 123/195 S, 195 H, 195 HC, 198 DA
See application file for complete search history.

(56) References Cited

U.S. PATENT DOCUMENTS

| | | | | |
|---|---|---|---|---|
| 4,753,201 | A * | 6/1988 | Fukuo et al. | 123/195 R |
| 4,773,366 | A * | 9/1988 | Seidl et al. | 123/196 R |
| 4,838,221 | A * | 6/1989 | Suemori | 123/195 H |
| 5,024,189 | A * | 6/1991 | Ushio et al. | 123/195 R |
| 5,054,442 | A * | 10/1991 | Pietsch et al. | 123/195 H |
| 5,452,692 | A * | 9/1995 | Spray et al. | 123/195 C |
| 5,501,189 | A * | 3/1996 | van Bezeij | 123/193.1 |
| 5,509,387 | A * | 4/1996 | Kaminski et al. | 123/195 R |
| 5,901,679 | A * | 5/1999 | Tanaka et al. | 123/195 C |
| 5,901,680 | A * | 5/1999 | Ozeki | 123/195 R |
| 6,192,852 | B1 * | 2/2001 | Gerhards et al. | 123/195 R |
| 6,308,680 | B1 * | 10/2001 | Prior | 123/195 R |
| 6,659,060 | B2 * | 12/2003 | Linder et al. | 123/192.2 |
| 6,684,845 | B2 * | 2/2004 | Cho | 123/195 H |
| 6,715,458 | B1 * | 4/2004 | Tappen | 123/195 R |
| 6,973,907 | B2 * | 12/2005 | Satou | 123/195 R |
| 2005/0217630 | A1 * | 10/2005 | Kajiwara et al. | 123/195 H |
| 2006/0081210 | A1 * | 4/2006 | Kajiwara et al. | 123/195 H |

(Continued)

FOREIGN PATENT DOCUMENTS

DE 22 57 651 C2 11/1982

(Continued)

OTHER PUBLICATIONS

German Office Action Dated Nov. 4, 2005 (Four (4) Pages).

*Primary Examiner*—Hai Huynh
(74) *Attorney, Agent, or Firm*—Crowell & Moring LLP

(57) ABSTRACT

Crankshaft bearings suitable for a reciprocating piston-type internal combustion engine having multiple cylinders are arranged in a housing made of a light metal alloy and include bearing bores for a crankshaft crank pins of a crankshaft. The bores having first and second bearing sections with first and second thrust bearings extending across a longitudinal plane of the crankshaft on both sides of a bearing parting plane. The second thrust bearings are part of a crankshaft bearing bridge connected to a crankcase. At least a portion of two thrust bearings of the crankshaft bearing bridge having neighboring or adjoining bore halves of the bearing bores is supported by connecting elements. The thrust bearings of the internal combustion engine open into longitudinal walls of the crankshaft bearing bridge with local widened areas in between.

14 Claims, 5 Drawing Sheets

U.S. PATENT DOCUMENTS

2006/0130799 A1* 6/2006 Paul et al. ..... 123/195 H

FOREIGN PATENT DOCUMENTS

| | | | |
|---|---|---|---|
| DE | 34 26 208 | C1 | 3/1986 |
| DE | 38 37 834 | C1 | 6/1989 |
| DE | 43 30 565 | C1 | 8/1994 |
| DE | 196 19 974 | C1 | 11/1997 |
| DE | 697 04 917 | T2 | 9/2001 |
| DE | 102 31 681 | A1 | 2/2003 |
| DE | 103 57 096 | A1 | 9/2004 |
| EP | 0 038 560 | A1 | 10/1981 |

* cited by examiner

CRANKSHAFT BEARING FOR AN INTERNAL COMBUSTION ENGINE

CROSS-REFERENCE TO RELATED APPLICATIONS

This application claims the priority of German Application No. 10 2004 061 684.1-13, filed Dec. 22, 2004, the disclosure of which is expressly incorporated by reference herein. This application is also related to U.S. application Ser. No. 11/313,754 (028987.56989US) in the name of Paul et al. filed concurrently herewith.

BACKGROUND AND SUMMARY OF THE INVENTION

The present invention relates to a crankshaft bearing for a reciprocating, piston-type, internal combustion engine having multiple cylinders arranged in a housing made of a light metal alloy, including bearing bores for crank pins of a crankshaft and first and second bearing sections with first and second thrust bearings running across a longitudinal plane of the crankshaft on both sides of a bearing parting plane, said second thrust bearings being part of a crankshaft bearing bridge connected to a crankcase.

A crankshaft bearing for an internal combustion engine is shown in DE 34 26 208 C1. A crankcase and a bearing crown attached thereto, forming part of a crankshaft bearing bridge, are made of a light metal alloy. The bearing crowns are configured as a cast sheathing for ferrometallic cores, with the cores contributing to an increase in rigidity of the bearing crowns and/or the crankshaft bearing bridge and also reducing the noise-producing bearing play between the bearing bore and the bearing pin of a crankshaft.

DE 43 30 565 C1 describes a crankshaft bearing which is provided in a housing made of a light metal alloy in an internal combustion engine and includes a bearing bore for a crank pin. With this crankshaft bearing, a device is effective in reducing the increased bearing play between the bearing bore and crank pin. This device is configured as a ring-like compensator element which operates between the bearing bore and the crank pin and is made of a material having a relatively large coefficient of thermal expansion.

Furthermore, bearing bridges for internal combustion engines are described in DE 22 57 651 and EP 0 038 560, where neighboring thrust bearings are supported only by longitudinal walls and/or longitudinal side members.

An object of the present invention is to provide a crankshaft bearing bridge for an internal combustion engine which is characterized by a high strength and low-noise bearing of the crankshaft with a simple design.

According to the present invention, this object can be achieved by providing that at least a portion of neighboring bore halves of the second thrust bearings of the crank shaft bearing bridge having bearing bores are supported by connecting elements, and the second thrust bearings of the internal combustion engine open into longitudinal walls of the crankshaft bearing bridge with local widened areas in between.

The main advantages achieved with the present invention include the fact that, due to the particular structural configuration of the crankshaft bearing bridge made of a light metal alloy, the bridge is advantageously and especially rigid and strong with a low weight. The rigid frame structure with the connecting elements between the thrust bearings of the crankshaft bearing bridge can be implemented with a low complexity without additional equipment that would cause bimetal effects. The connecting elements and/or the walls forming them not only act as an oil plane but also these connecting elements are arranged in such a way that they result in relatively large ventilation cross-sections, thereby reducing pump losses. Furthermore, this frame structure in combination with the thermally treated thrust bearings made of the light metal alloy contributes to a uniform, controlled increase in the bearing bore over the operating temperature of the internal combustion engine, i.e., this at least reduces the ovalization of said bearing bore, which would otherwise be the case.

DETAILED DESCRIPTION OF THE DRAWINGS

Figure 1:
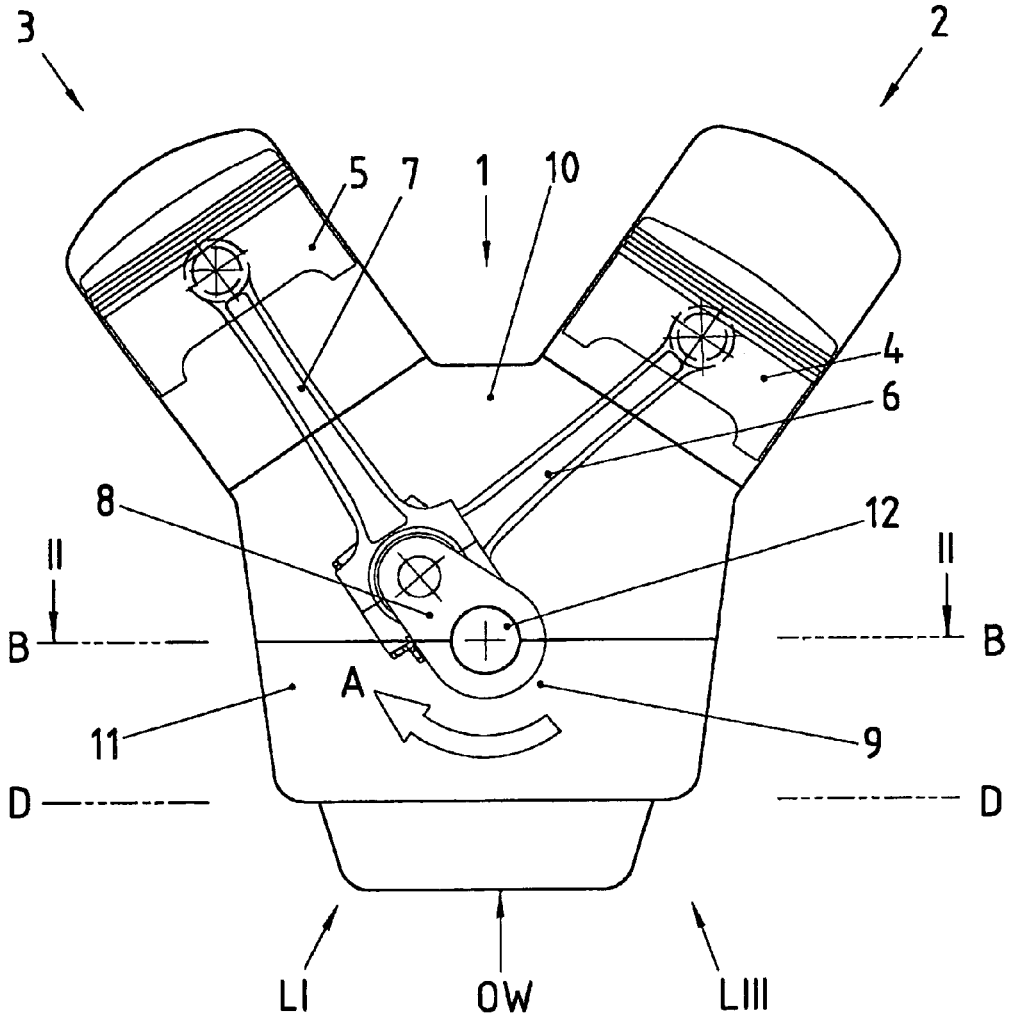
FIG. 1 is a schematic cross-sectional view through an internal combustion engine having the crankshaft bearing according to the present invention.

An internal combustion engine 1 of the reciprocating piston-type having multiple cylinders is configured for installation in a motor vehicle (not shown) and includes two cylinder rows 2, 3 in a V-shaped arrangement in which the pistons 4, 5 operate. The pistons 4, 5 are connected by respective connecting rods 6, 7 to a crankshaft 8 which rotates in the direction of arrow A and is accommodated by crankshaft bearings 9. The crankshaft bearings 9 are arranged in a housing 10 made of a light metal alloy and have bearing bores 11 for crank pins 12 of the crankshaft 8. In addition, a first bearing section 13 and a second bearing section 14 with first thrust bearings 15 and second thrust bearings 16, 17, 18, 19 and 20 (FIG. 2) are provided on both sides of a bearing parting plane B-B. The first thrust bearings 15 are integrated into a crankcase 15' configured above the parting plane B-B, whereas the second thrust bearings 16, 17, 18, 19 and 20 are part of a crankshaft bearing bridge 21, also known as a "bed plate."

The second thrust bearings 16, 17, 18, 19 and 20 extend across a central longitudinal plane C-C of the crankshaft 8 and are equipped with bore halves 22 of the bearing bores 11. Neighboring (or adjoining) thrust bearings 16 and 17, 17 and 18, 18 and 19, 19 and 20 are supported by connecting elements 23, and at least the thrust bearings 17 through 19 (which may also be referred to as bearing crowns) open into longitudinal walls 25, 26 of the crankshaft bearing bridge 21 through local Y-shaped widened areas 24. In other words, the side walls 27, 28 of the thrust bearing 17, for example, become wider with legs 29, 30 toward the longitudinal walls 25, 26 of the crankshaft bearing bridge 21.

Figure 2:
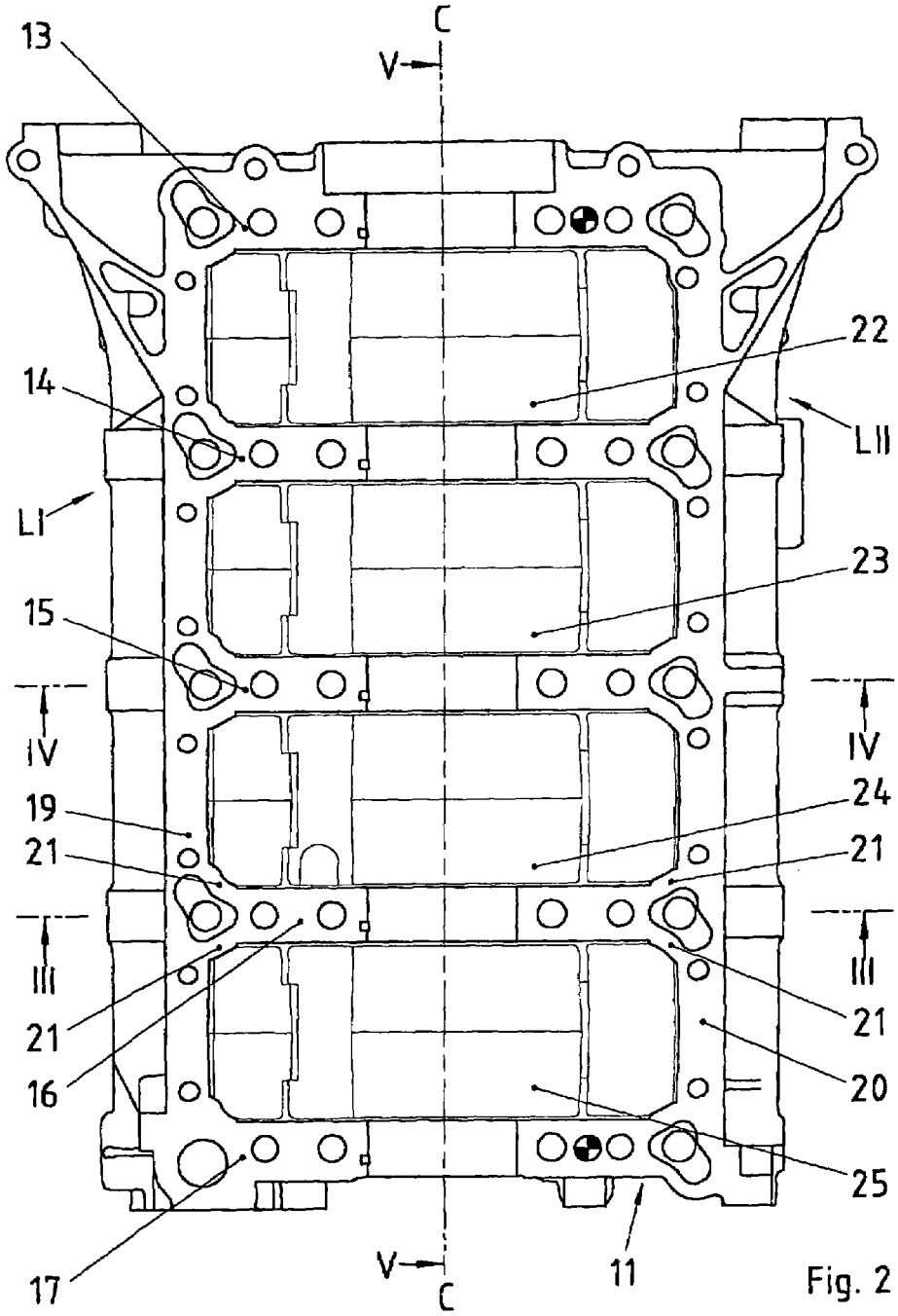
FIG. 2 is a sectional view along line II-II of FIG. 1 from above of a crankshaft bearing bridge of the internal combustion engine.
Figure 3:
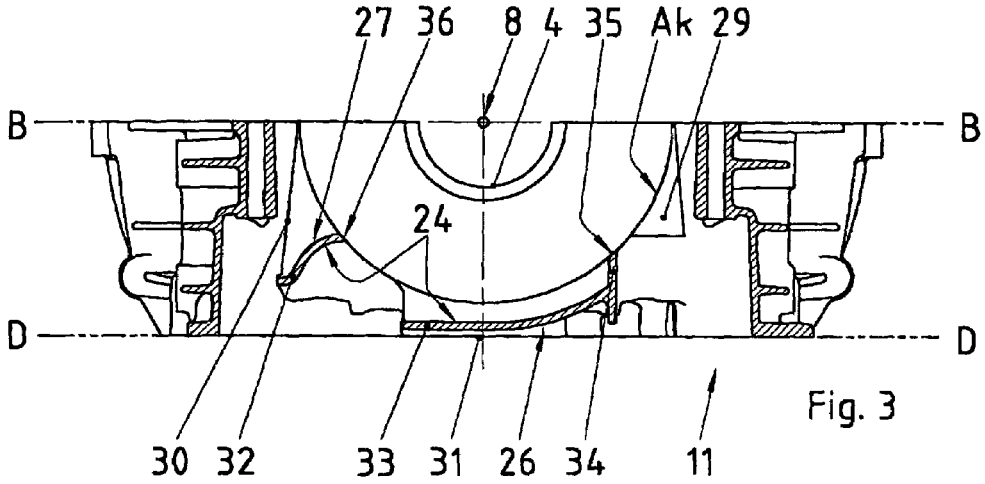
FIG. 3 is a sectional view along line III-III in FIG. 2 on an enlarged scale.
Figure 4:
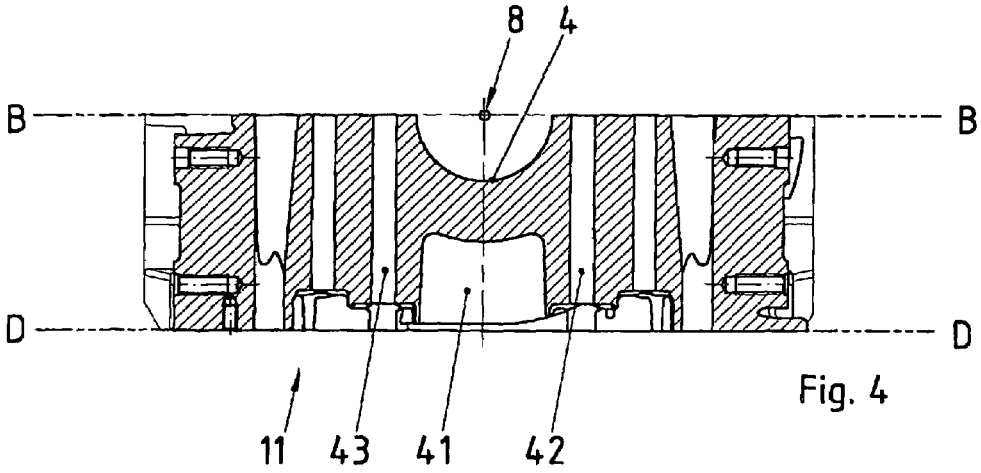
FIG. 4 is a sectional view along line IV-IV of FIG. 2 from below of the crankshaft bearing bridge of the internal combustion engine.

FIG. 2 shows that the thrust bearings 16, 17, 18, 19 and 20, the connecting elements 23 and the longitudinal walls 25, 26 of the crankshaft bearing bridge 21 are combined structurally to result in a rigid frame structure. For example, connecting element 23, which is provided between the two neighboring thrust bearings 16, 17, has two element walls 31, 32 (FIG. 3) that are separate from one another and are relatively thin walled and profiled. The element wall 32 has a curved arc which guides the oil lubricant, and the element wall 31 has an approximately horizontal T shape which increases its strength, where the free ends 33, 34 of the respective element walls 31, 32 act as oil planes for connecting rods 6, 7 moving between the thrust bearings 16, 17, for example, their stripper contours are labeled as Ak1 and Ak2. In addition, as seen in FIG. 3, the element walls 31, 32 are configured and arranged to yield relatively large ventilation cross-sections 35, 36 (arrows Pf1 and Pf2) between the respective longitudinal walls 25, 26.

Figure 6:
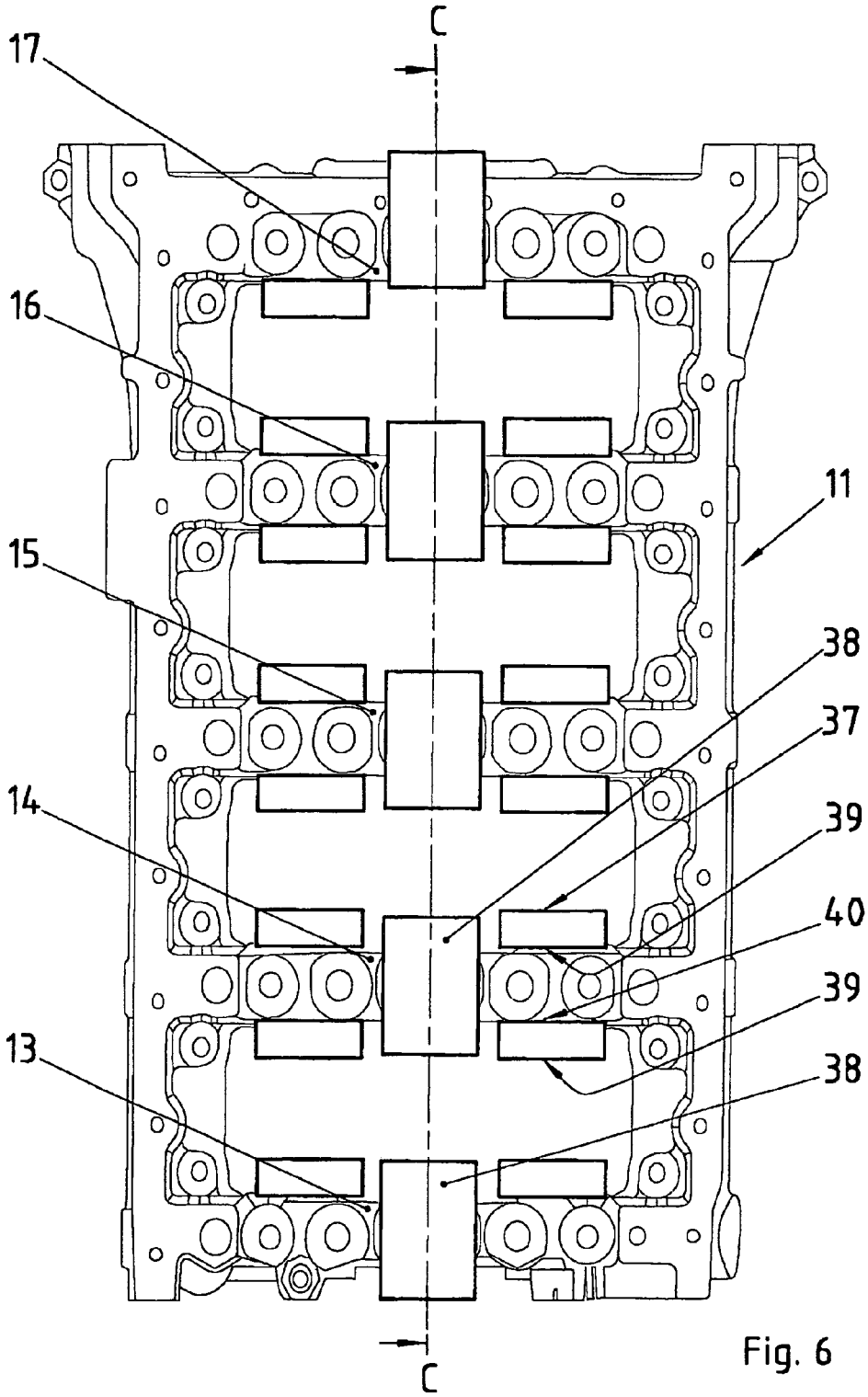
FIG. 6 is a schematic view of the crankshaft bearing bridge of the internal combustion engine according to FIG. 1 as seen from above.

FIG. 6 shows how the strength properties of the thrust bearings 16, 17, 18, 19 and 20 are optimized by a targeted temperature treatment thereof. The strength properties are influenced in a positive sense by controlled cooling (directed solidification of the light metal melt) of the crankshaft bearing bridge 21 at the time of manufacture, namely by applying first cooling elements 37 and second cooling elements 38, for example., to the side walls 27, 28 and/or four halves 22 of the thrust bearings 16, 17, 18, 19 and 20. The first and second cooling elements 37, 38 are made of a ferromagnetic material, with the first cooling elements 37 being plates which are attached to the side walls 27, 28 on both sides of the thrust bearings. For example, bearing 17. However, the second cooling elements 38 are designed as cylinders having a circular cross-section and are provided with the shape of the bore halves 22 of the thrust bearings 16, 17, 18, 19 and 20.

Figure 5:
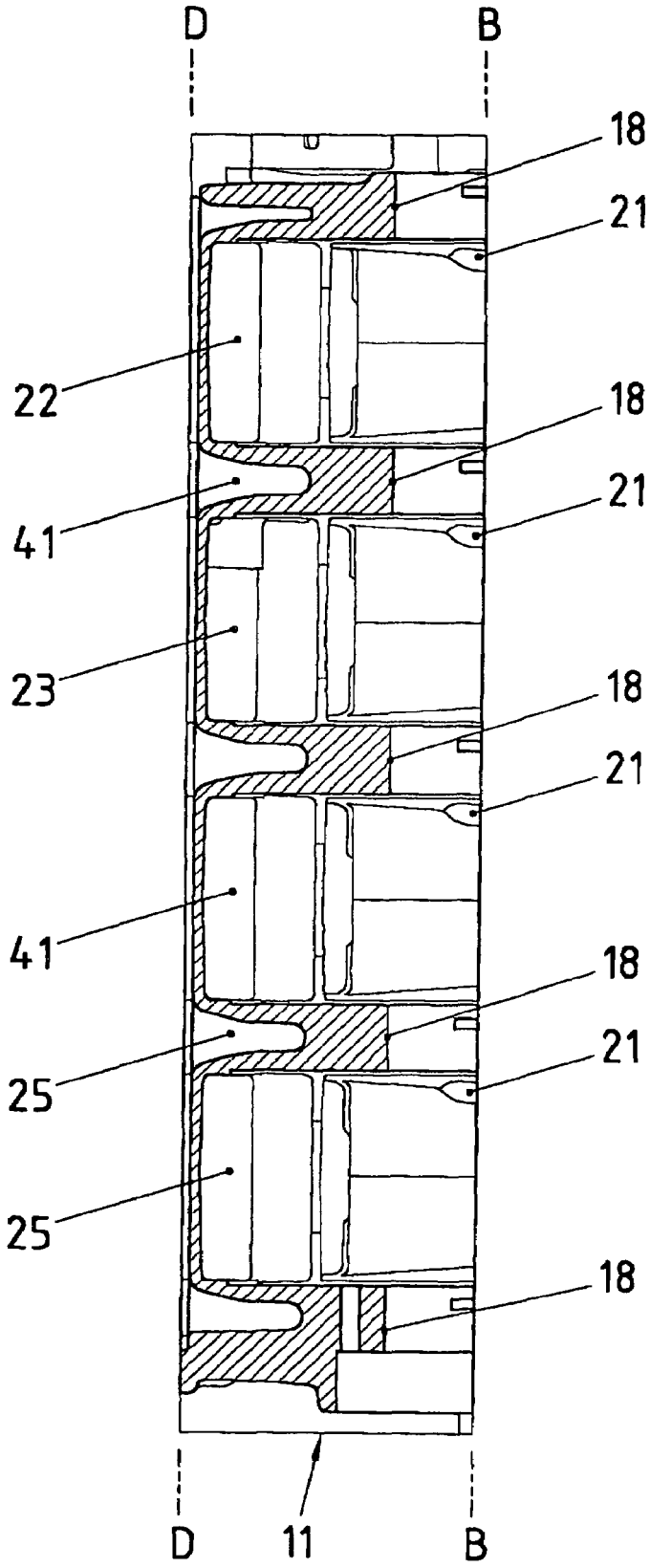
FIG. 5 is a sectional view along the line V-V in FIG. 4.

Relief recesses 39 are integrated into the thrust bearings 16, 17, 18, 19 and 20 of the crankshaft bearing bridge 21 (FIG. 5). These relief recesses are provided beneath the bore halves 22 in the thrust bearings. The relief devices 39, the size of which can be determined empirically or by calculation, are a U-shaped cross-section and extend between through-bores 40 and 41 which serve to accommodate fastening screws. The crankshaft bearing bridge 21 is held in position on the crankcase 15'0 of the internal combustion engine 1 by these fastening screws.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Crankshaft bearing for a reciprocating piston-type internal combustion engine having multiple cylinders arranged in a housing made of a light metal alloy, comprising bearing bores for crank pins of a crankshaft, and first and second bearing sections with first and second thrust bearings extending across a crankshaft longitudinal plane on both sides of a bearing parting plane, said second thrust bearings being part of a crankshaft bearing bridge connected to a crankcase, connecting elements operatively supporting at least a portion of adjoining bore halves of the second thrust bearings of the crankshaft bearing bridge having bearing bores, wherein the second thrust bearings of the internal combustion engine open into longitudinal walls of the crankshaft bearing bridge with local widened areas therebetween, the connecting elements are configured as separate, relatively thin and profiled element walls between the adjoining thrust bearings, and free ends of the profiled element walls are configured as oil planes for internal combustion engine connecting rods arranged to move between the thrust bearings.

2. Crankshaft bearing as claimed in claim 1, wherein the widened areas are Y-shaped.

3. Crankshaft bearing as claimed in claim 1, wherein the connecting elements, the thrust bearings and the longitudinal walls together form a rigid frame structure.

4. Crankshaft bearing as claimed in claim 3, wherein the element walls are arranged to form relatively large ventilation cross-sections between the longitudinal walls and the element walls.

5. Crankshaft bearing as claimed in claim 1, wherein the connecting elements, the thrust bearings and the longitudinal walls together form a rigid frame structure.

6. Crankshaft bearing as claimed in claim 1, wherein the thrust bearings are configured via targeted thermal treatment so as to have optimized strength properties.

7. Crankshaft bearing as claimed in claim 6, wherein the thrust bearings have strength properties that are increased by first and second cooling elements provided on said thrust bearings in a targeted manner during manufacture of the crankshaft bearing bridge.

8. Crankshaft bearing as claimed in claim 7, wherein the first cooling elements are operatively arranged on side walls of the thrust bearings.

9. Crankshaft bearing as claimed in claim 8, wherein the second cooling elements are operatively arranged at both sides of the bore halves of the thrust bearings.

10. Crankshaft bearing as claimed in claim 1, wherein relief recesses are operatively arranged in the thrust bearings of the crankshaft bearing bridge.

11. Crankshaft bearing as claimed in claim 10, wherein the relief recesses are provided beneath bore halves in the thrust bearings.

12. Crankshaft bearing as claimed in claim 10, wherein the relief recesses have a U-shaped cross-section.

13. Crankshaft bearing as claimed in claim 10, wherein the relief recesses extend between through-bores for fastening screws of the crankshaft bearing bridge.

14. In a reciprocating piston-type internal combustion engine having multiple cylinders, the improvement comprising a crankshaft bearing arrangement arranged in a housing made of a light metal alloy, comprising bearing bores for crank pins of a crankshaft, and first and second bearing sections with first and second thrust bearings extending across a crankshaft longitudinal plane on both sides of a bearing parting plane, said second thrust bearings being part of a crankshaft bearing bridge connected to a crankcase, connecting elements operatively supporting at least a portion of adjoining bore halves of the second thrust bearings of the crankshaft bearing bridge having bearing bores, wherein the second thrust bearings open into longitudinal walls of the crankshaft bearing bridge with local widened areas therebetween, the connecting elements are configured as separate, relatively thin and profiled element walls between the adjoining thrust bearings, and free ends of the profiled element walls are configured as oil planes for internal combustion engine connecting rods arranged to move between the thrust bearings.

* * * * *